US010876542B2

(12) United States Patent
Lin et al.

(10) Patent No.: US 10,876,542 B2
(45) Date of Patent: Dec. 29, 2020

(54) AXIAL FLOW FAN

(71) Applicant: Acer Incorporated, New Taipei (TW)

(72) Inventors: Kuang-Hua Lin, New Taipei (TW); Cheng-Wen Hsieh, New Taipei (TW); Wen-Neng Liao, New Taipei (TW)

(73) Assignee: Acer Incorporated, New Taipei (TW)

( * ) Notice: Subject to any disclaimer, the term of this patent is extended or adjusted under 35 U.S.C. 154(b) by 62 days.

(21) Appl. No.: 16/199,232

(22) Filed: Nov. 26, 2018

(65) Prior Publication Data

US 2020/0049159 A1 Feb. 13, 2020

(30) Foreign Application Priority Data

Aug. 13, 2018 (TW) ..... 107128177 A

(51) Int. Cl.
*F04D 29/38* (2006.01)

(52) U.S. Cl.
CPC ..... *F04D 29/384* (2013.01); *F04D 29/388* (2013.01); *F05D 2240/301* (2013.01); *F05D 2260/96* (2013.01)

(58) Field of Classification Search
CPC ..... F04D 29/38; F04D 29/384; F04D 29/388; F05D 2240/301; F05D 2260/96
See application file for complete search history.

(56) References Cited

U.S. PATENT DOCUMENTS 8,133,008 B2 * 3/2012 Tsuchiya ..... F01D 5/145 415/115
9,394,794 B2 * 7/2016 Guemmer ..... F01D 5/145
9,470,091 B2 * 10/2016 Gomez ..... F01D 5/022
10,036,392 B2 * 7/2018 Gallina ..... F04D 29/388
2004/0062654 A1 * 4/2004 Chang ..... F04D 29/38 416/223 R
2010/0303634 A1 * 12/2010 Long ..... F04D 29/681 416/90 A
2011/0318172 A1 * 12/2011 Hoeger ..... F01D 5/146 415/181
2017/0218774 A1 * 8/2017 Bloxham ..... F01D 9/041

FOREIGN PATENT DOCUMENTS

| | | |
|---|---|---|
| AU | 2010202406 | 1/2011 |
| CN | 202707606 | 1/2013 |
| CN | 204041544 | 12/2014 |
| TW | 200513168 | 4/2005 |
| TW | I284708 | 8/2007 |
| TW | M540198 | 4/2017 |

* cited by examiner

*Primary Examiner* — Nathaniel E Wiehe
*Assistant Examiner* — Ryan C Clark
(74) *Attorney, Agent, or Firm* — JCIPRNET

(57) ABSTRACT

An axial flow fan includes a hub and a plurality of fan blade sets. The hub is configured to rotate around an axis. The fan blade sets are disposed at the peripheral of the hub, wherein each of the fan blade sets includes a first fan blade and a second fan blade arranged side by side along the axis and a flow channel is defined by each of the first fan blades and the corresponding second fan blade. Each of the flow channels has an inlet and an outlet opposite to each other, wherein at least one of each of the first fan blades and the corresponding second fan blade has a flow guiding hole and each of the flow guiding holes is located between the inlet and the outlet. Each of the flow guiding holes is communicated with the flow channel.

7 Claims, 6 Drawing Sheets

AXIAL FLOW FAN

CROSS-REFERENCE TO RELATED APPLICATION

This application claims the priority benefit of Taiwan application serial no. 107128177, filed on Aug. 13, 2018. The entirety of the above-mentioned patent application is hereby incorporated by reference herein and made a part of this specification.

BACKGROUND

Technical Field

The disclosure relates to a fan, and more particularly to an axial flow fan.

Description of Related Art

With the development of technology, centrifugal fans and axial flow fans have become more and more widely used for heat dissipation in technological products. Take the axial flow fan as an example, the flow direction of the airflow generated during operation of the axial flow fan is theoretically parallel to an axis which served as a rotational reference of the axial flow fan.

However, during the actual operation of the axial flow fan, part of the airflow flowing past a flow channel between two fan blades is guided by the fan blades and flows out of the flow channel along the flow direction non-parallel to the axis, causing the axial flow rate of the airflow generated during the operation of the axial flow fan to be insufficient. On the other hand, in order to increase wind pressure to satisfy products with high demand for heat dissipation, the number of fan blades of the axial flow fan is constantly increasing. However, having too many fan blades causes the distance between two adjacent fan blades to be overly close, resulting in airflow disturbance and friction with the blade surfaces of the fan blades, thereby increasing the noise at work.

SUMMARY

The disclosure provides an axial flow fan which can increase axial flow rate and reduce noise production.

The axial flow fan of the disclosure includes a hub and multiple fan blade sets. The hub is configured to rotate around an axis. The multiple fan blade sets are disposed at the peripheral of the hub, wherein each of the fan blade sets includes a first fan blade and a second fan blade arranged side by side along the axis. A flow channel is defined by each of the first fan blades and the corresponding second fan blade. Each of the flow channels has an inlet and an outlet opposite to each other, wherein at least one of each of the first fan blades and the corresponding second fan blade is provided with a flow guiding hole. Each of the flow guiding holes is located between the inlet and the outlet of the corresponding flow channel. Each of the flow guiding holes is communicated with the corresponding flow channel.

Based on the above, each of the fan blade sets of the axial flow fan of the disclosure is provided with at least one flow guiding hole for increasing the flow rate of airflow into the flow channel of each of the fan blade sets. The airflow flowing past the flow channel of each of the fan blade sets may be ejected from the outlet of the flow channel. The flow direction of the airflow ejected from the outlet of the flow channel is parallel to the hub as the axis of rotational reference. Therefore, the axial flow fan of the disclosure not only increases the axial flow rate, but also prevents the airflow disturbance to reduce noise produced during the operation of the axial flow fan.

To make the aforementioned and other features of the disclosure more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DETAILED DESCRIPTION OF DISCLOSED EMBODIMENTS

Figure 1:
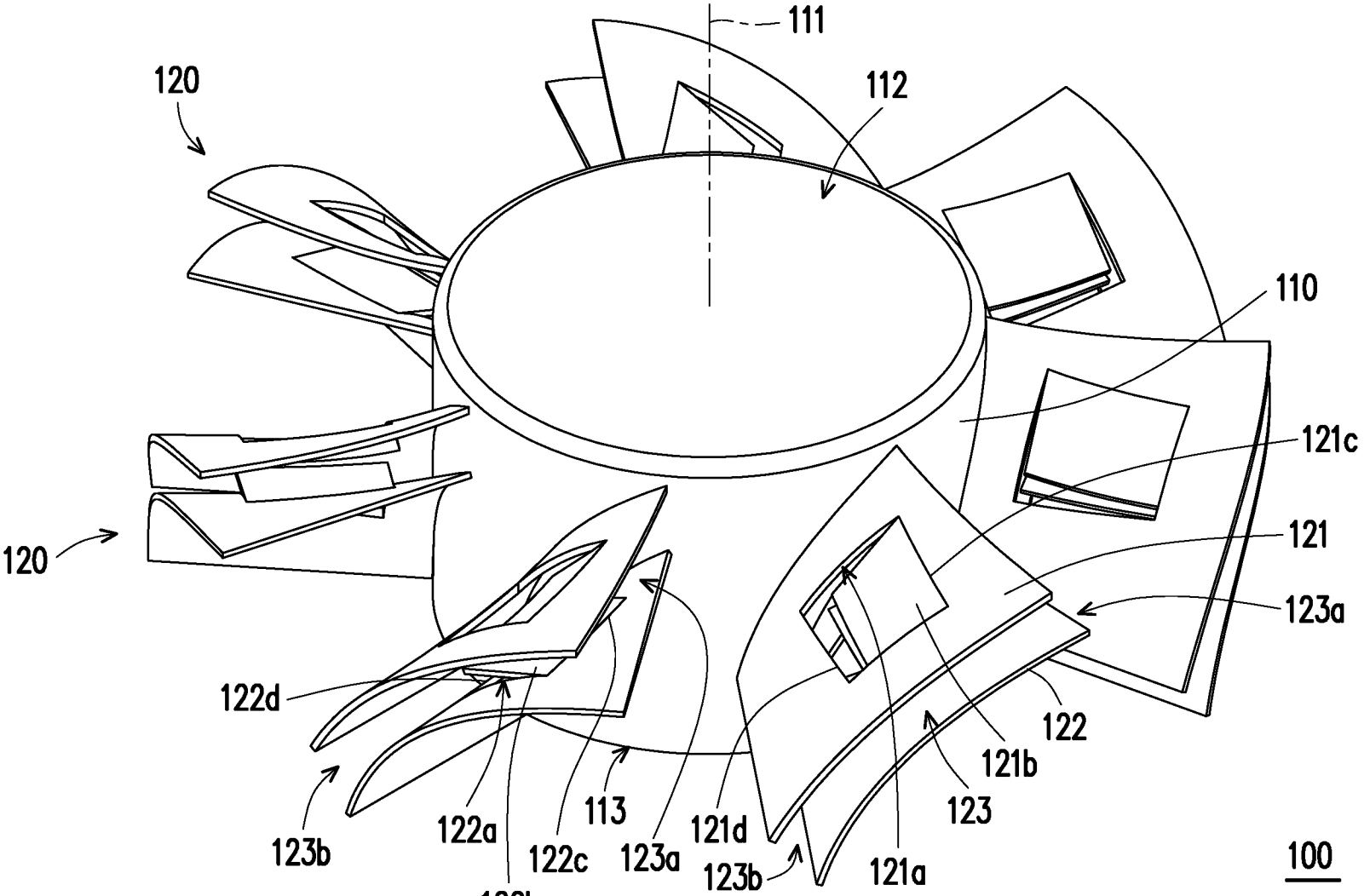
FIG. 1 is a schematic view of a structure of an axial flow fan according to the first embodiment of the disclosure.
Figure 2:
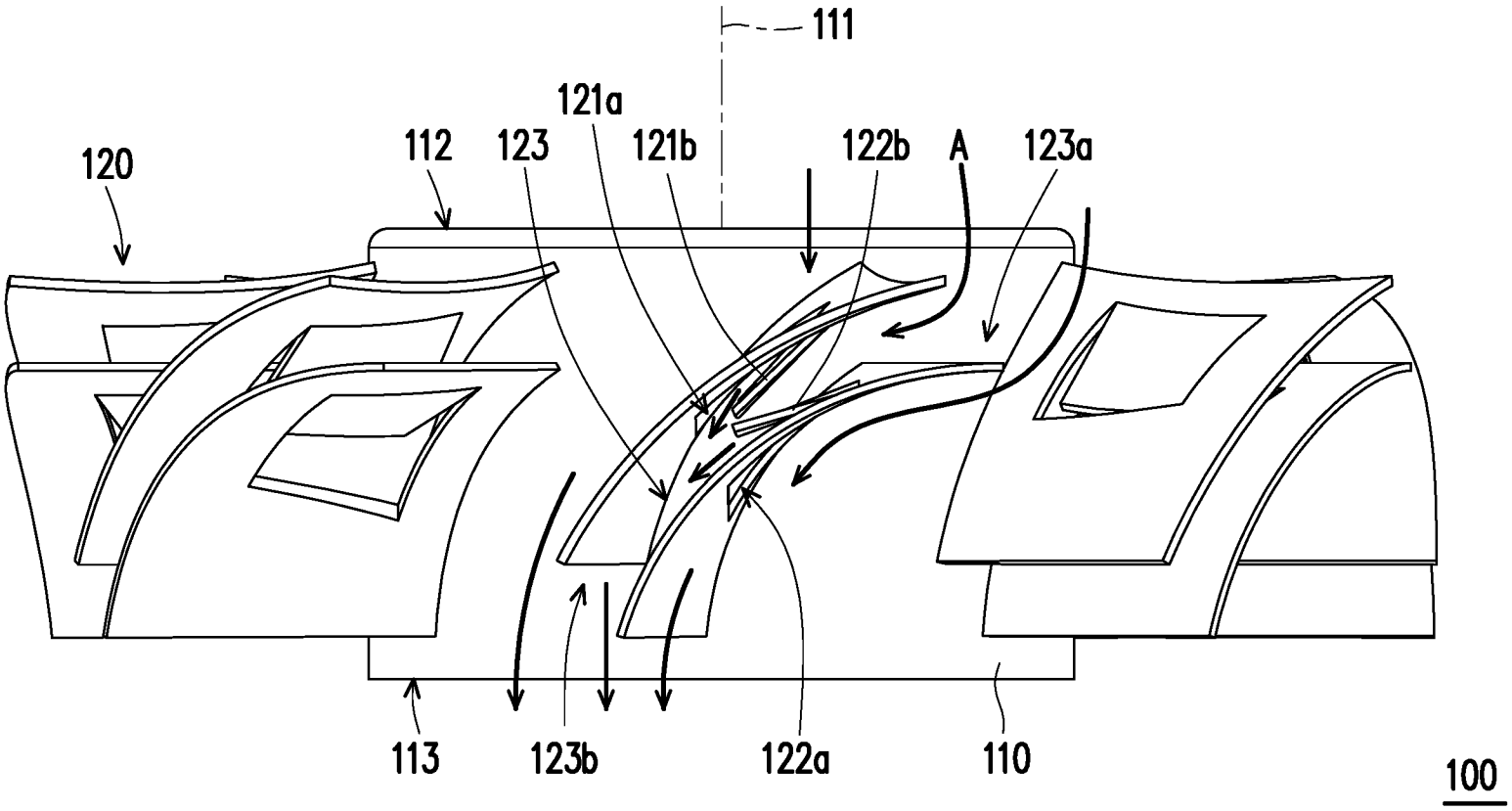
FIG. 2 is a schematic side view of the axial flow fan according to the first embodiment of the disclosure.
Figure 3:
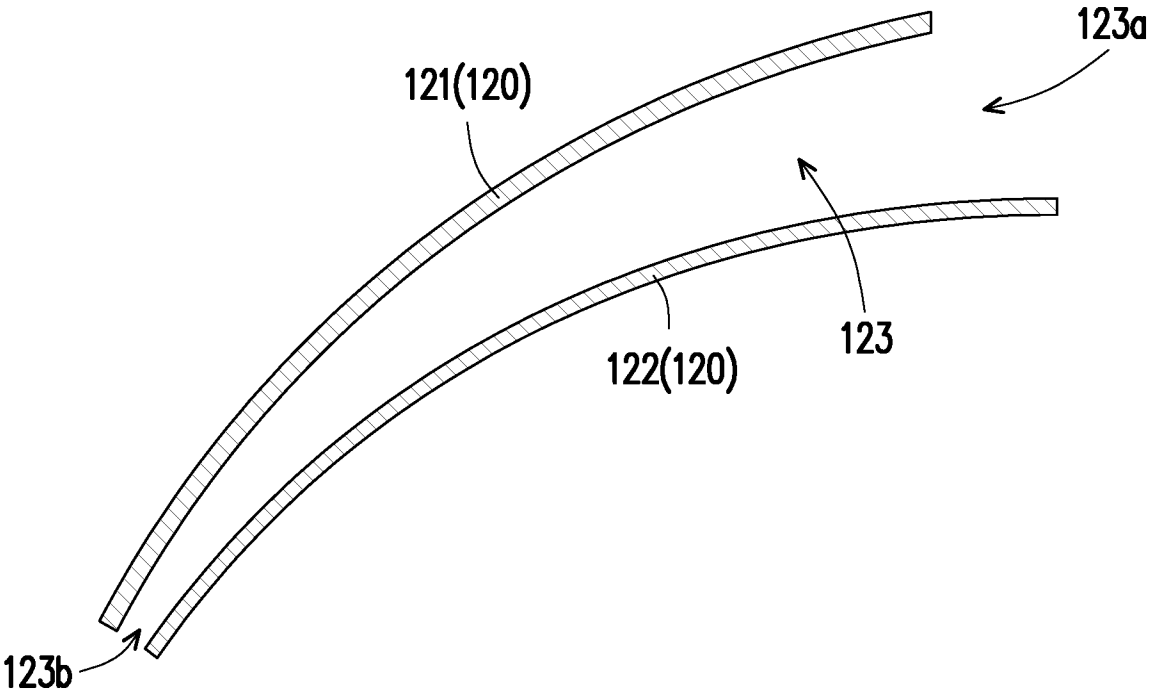
FIG. 3 is a schematic cross-sectional view of any one of fan blade sets according to the first embodiment of the disclosure.

FIG. 1 is a schematic view of a structure of an axial flow fan according to the first embodiment of the disclosure. FIG. 2 is a schematic side view of the axial flow fan according to the first embodiment of the disclosure. FIG. 3 is a schematic cross-sectional view of any one of fan blade sets according to the first embodiment of the disclosure. Here, the cross section of FIG. 3 is parallel to an axis 111 of a hub 110, and flow guiding portions 121*a* and 122*a* are omitted. Please refer to FIG. 1 to FIG. 2 first, in the embodiment, an axial flow fan 100 may include the hub 110 and a plurality of fan blade sets 120. The fan blade sets 120 are, for example, sequentially arranged in a counterclockwise or a clockwise direction along the peripheral of the hub 110 and surround the axis 111 which served as a rotational reference of the hub 110. On the other hand, the fan blade sets 120 may adopt metal fan blades to meet the design requirement of thinning, but is not limited to such. In other embodiments, the material of the fan blade sets may be plastic, acrylic, carbon fiber, or other suitable materials.

Using one of the fan blade sets 120 for illustration, the fan blade set 120 includes a first fan blade 121 and a second fan blade 122 arranged side by side along the axis 111. The first fan blade 121 and the second fan blade 122 overlap with each other on the axis 111, and a flow channel 123 is defined therebetween. The hub 110 has a top 112 and a bottom 113 opposite to each other. The first fan blade 121 and the second fan blade 122 are arranged side by side between the top 112 and the bottom 113, and the first fan blade 121 is located between the top 112 and the second fan blade 122. On the other hand, the flow channel 123 has an inlet 123*a* and an outlet 123*b* opposite to each other. The inlet 123*a* is close to the top 112 and the outlet 123*b* is close to the bottom 113.

During the operation of the axial flow fan 100, the hub 110 rotates around the axis 111, and the fan blade set 120 rotates together with the hub 110, thereby causing an airflow A. Furthermore, the airflow A may flow from the top 112 of the hub 110 into the flow channel 123 via the inlet 123*a*. Next, the airflow A in the flow channel 123 flows toward the outlet 123*b* and flows out of the flow channel 123 via the outlet 123*b*, and further flows toward the bottom 113 of the hub 110. In addition, the airflow A may also flow from the top 112 of the hub 110 into between two adjacent fan blade sets 120, and further flows toward the bottom 113 of the hub 110.

In the embodiment, the first fan blade 121 and the second fan blade 122 disposed in sets are respectively provided with flow guiding holes 121*a* and 122*a*. The flow guiding holes 121*a* and 122*a* are both communicated with the flow channel 123, and the flow guiding holes 121*a* and 122*a* are both located between the inlet 123*a* and the outlet 123*b* of the flow channel 123. Based on the design of the flow guiding holes 121*a* and 122*a*, the airflow A flowing past between the two adjacent fan blade sets 120 may flow into the flow channel 123 via the flow guiding hole 121*a* or the flow guiding hole 122*a* to increase the flow rate of the airflow A flowing past the flow channel 123 and to prevent the airflow A from disturbing between the two adjacent fan blade sets 120, thereby reducing the noise produced during the operation of the axial flow fan 100.

Furthermore, the first fan blade 121 and the second fan blade 122 are respectively provided with flow guiding portions 121*b* and 122*b*. The flow guiding portion 121*b* extends into the flow channel 123 via the flow guiding hole 121*a* and the flow guiding portion 122*b* extends into the flow channel 123 via the flow guiding hole 122*a*. The flow guiding hole 121*a* and the flow guiding hole 122*a* overlap with each other on the axis 111.

Also, the flow guiding portion 121*b* and the flow guiding portion 122*b* overlap with each other on the axis 111, but the flow guiding portion 121*b* is kept at a distance from the flow guiding portion 122*a* to allow the airflow A to pass smoothly.

Furthermore, the flow guiding portions 121*b* and 122*b* extended into the flow channel 123 both extend toward the outlet 123*b*. The flow guiding hole 121*a* has a first inner edge 121*c* and a second inner edge 121*d* opposite to each other and arranged side by side between the inlet 123*a* and the outlet 123*b*. The first inner edge 121*c* is located between the second inner edge 121*d* and the inlet 123*a*. Similarly, the flow guiding hole 122*a* has a first inner edge 122*c* and a second inner edge 122*d* opposite to each other and arranged side by side between the inlet 123*a* and the outlet 123*b*. The first inner edge 122*c* is located between the second inner edge 122*d* and the inlet 123*a*. On the other hand, the flow guiding portion 121*b* is connected to the first inner edge 121*c* and extends toward the outlet 123*b*. Similarly, the flow guiding portion 122*b* is connected to the first inner edge 122*c* and extends toward the outlet 123*b*. Based on the design of the flow guiding portions 121*b* and 122*b*, the airflow A flowing past the flow guiding hole 121*a* or the flow guiding hole 122*a* may be guided into the flow channel 123 by the flow guiding portion 121*b* or the flow guiding portion 122*b*. Also, the airflow A flowed into the flow channel 123 may be ensured to flow toward the outlet 123*b*.

Please refer to FIG. 1 to FIG. 3, in the embodiment, the distance between the first inner edge 121*c* and the inlet 123*a* is less than the distance between the second inner edge 121*d* and the outlet 123*b*. Similarly, the distance between the first inner edge 122*c* and the inlet 123*a* is less than the distance between the second inner edge 122*d* and the outlet 123*b*. On the other hand, the aperture of the flow channel 123 is gradually decreased from the inlet 123*a* to the outlet 123*b*. In other words, the flow channel 123 has multiple cross sections parallel to the axis 111, and the areas of the cross sections closer to the inlet 123*a* is larger than the areas of the cross sections closer the outlet 123*a*.

Based on Bernoulli's principle, the airflow A in the flow channel 123 is continuously accelerated during the flow from the inlet 123*a* to the outlet 123*a*, and is finally ejected from the outlet 123*a*. Also, the flow direction of the airflow A ejected from the outlet 123*a* is parallel to the axis 111 of the hub 110. Next, since the flow guiding holes 121*a* and 122*a* are both disposed close to the inlet 123*a*, the airflow A flowed into the flow channel 123 via the flow guiding hole 121*a* or the flow guiding hole 122*a* may obtain a larger amount of increase in flow velocity. On the other hand, in the case when the flow velocity of the airflow A at the outlet 123*a* is large, the pressure at the outlet 123*a* is lower than that of the surrounding, so the airflow A of the surrounding can be guided toward the outlet 123*a* to reduce the generation of non-axial airflow and improve the axial flow rate.

Other embodiments will be exemplified below for illustration. Only the differences between the embodiments will be illustrated, and same or similar structural designs and operational principles will not be reiterated.

Figure 4:
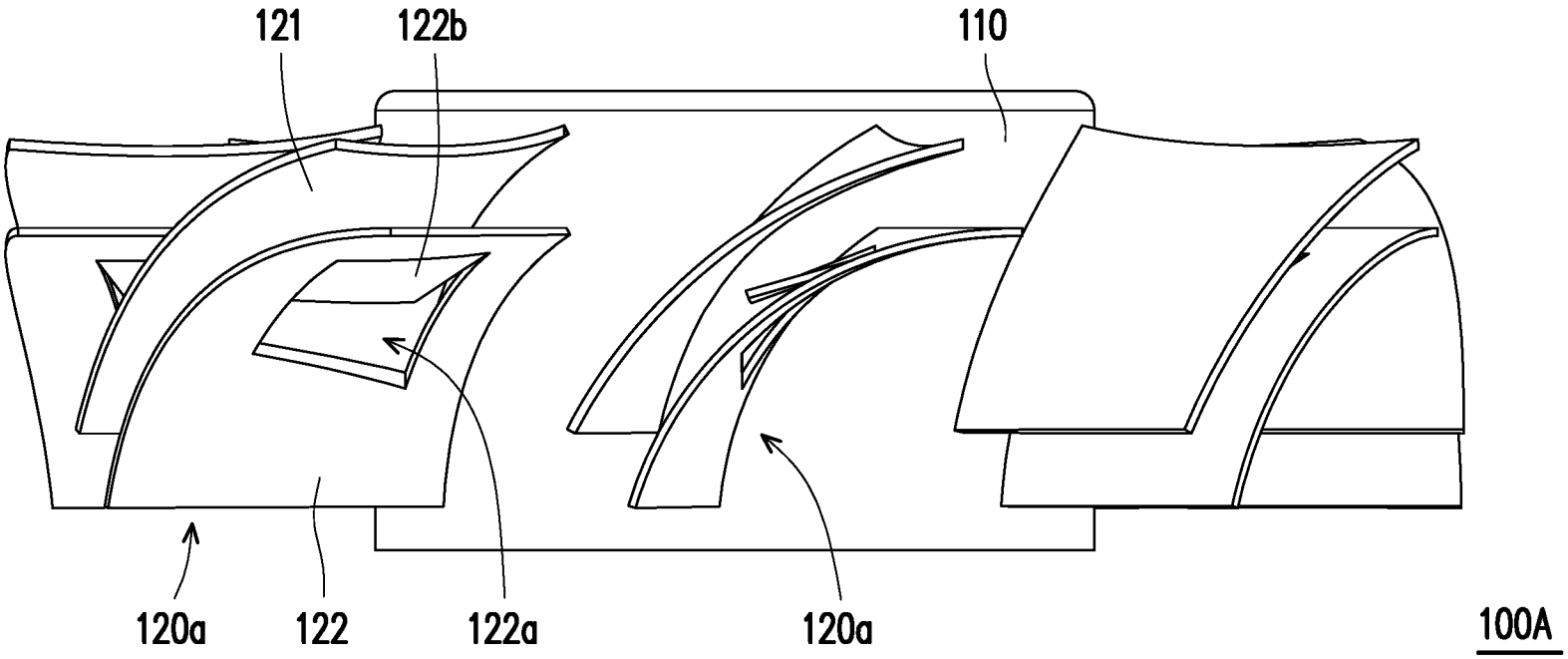
FIG. 4 is a schematic side view of an axial flow fan according to the second embodiment of the disclosure.

FIG. 4 is a schematic side view of an axial flow fan according to the second embodiment of the disclosure. Please refer to FIG. 4, the difference between an axial flow fan 100A of the embodiment and the axial flow fan 100 of the first embodiment is: the first fan blade 121 of a fan blade set 120*a* is not provided with a flow guiding hole or a flow guiding portion.

Figure 5:
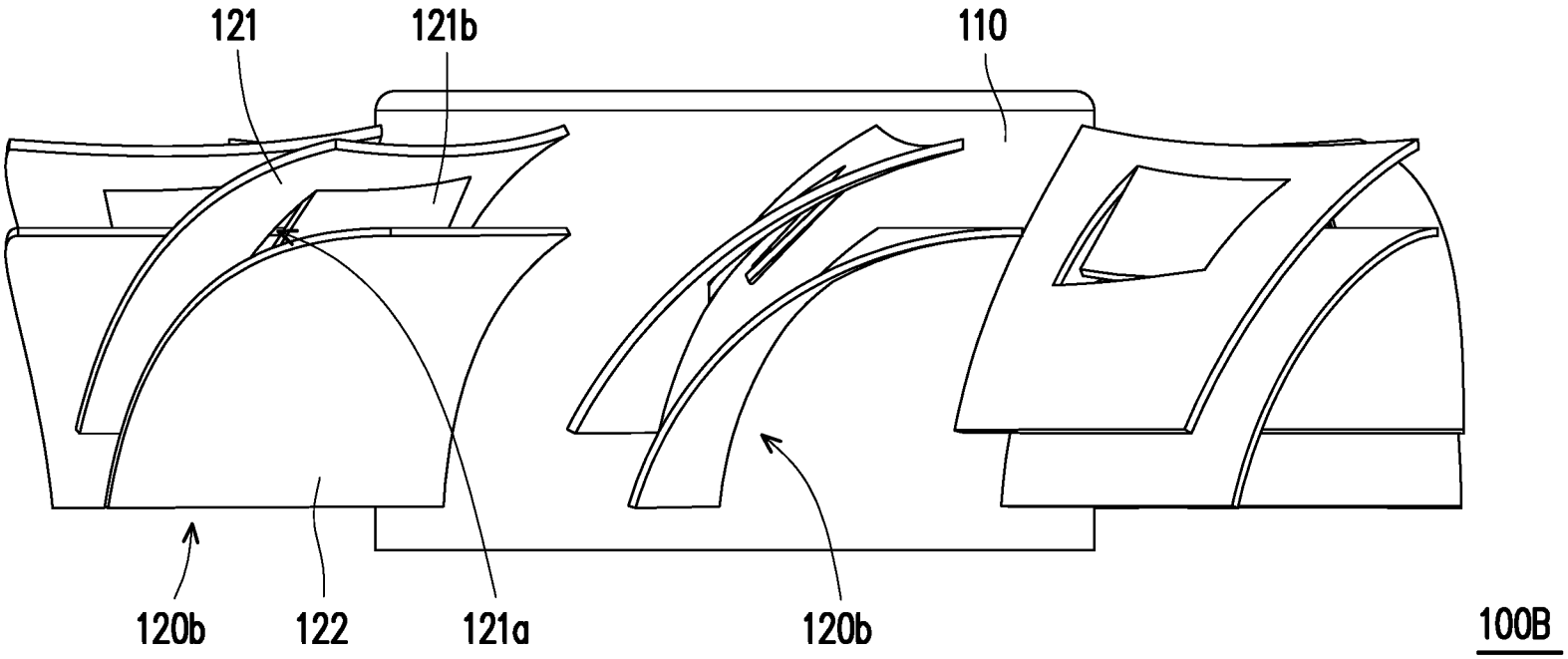
FIG. 5 is a schematic side view of an axial flow fan according to the third embodiment of the disclosure.

FIG. 5 is a schematic side view of an axial flow fan according to the third embodiment of the disclosure. Please refer to FIG. 5, the difference between an axial flow fan 100B of the embodiment and the axial flow fan 100 of the first embodiment is: the second fan blade 122 of a fan blade set 120*b* is not provided with a flow guiding hole or a flow guiding portion.

Figure 6:
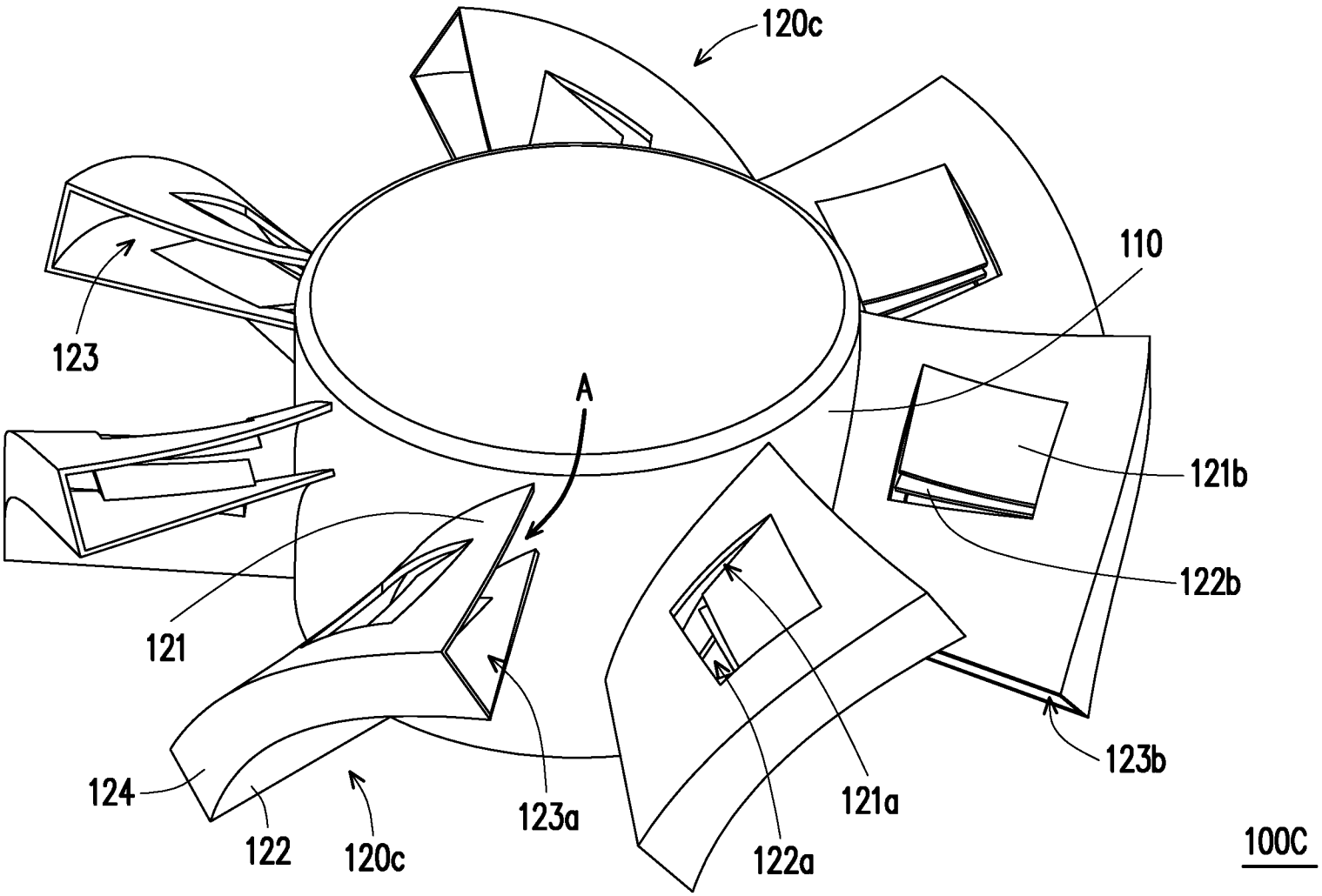
FIG. 6 is a schematic view of a structure of an axial flow fan according to the fourth embodiment of the disclosure.

FIG. 6 is a schematic view of a structure of an axial flow fan according to the fourth embodiment of the disclosure. Please refer to FIG. 6, the difference between an axial flow fan 100C of the embodiment and the axial flow fan 100 of the first embodiment is: a fan blade set 120*c* further includes a side wall 124 configured to connect the first fan blade 121 and the second fan blade 122, and the flow guiding holes 121*a* and 122*a* are located between the hub 110 and the side wall 124. In other words, the first fan blade 121 and the second fan blade 122 respectively have side edges that are relatively far from the hub 110, and the side wall 124 connects the two side edges which are arranged side by side to ensure that the airflow A in the flow channel 123 flows from the inlet 123*a* toward the outlet 123*b*.

Based on the above, each of the fan blade sets of the axial flow fan of the disclosure is provided with at least one flow guiding hole for increasing the flow rate of the airflow into the flow channel of each of the fan blade sets. The aperture of the flow channel of each of the fan blade sets is gradually decreased from the inlet to the outlet to allow the airflow flowing past the flow channel of each of the fan blade sets to be accelerated and ejected from the outlet of the flow channel. The flow direction of the airflow ejected from the outlet of the flow channel is parallel to the axis which served as the rotational reference of the hub. Therefore, the axial flow fan of the disclosure not only increases the axial flow rate, but also prevents the airflow disturbance to reduce the noise produced during the operation of the axial flow fan.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. An axial flow fan comprising:

a hub, configured to rotate around an axis; and a plurality of fan blade sets, disposed at the peripheral of the hub, wherein each of the fan blade sets comprises a first fan blade and a second fan blade arranged side by side along the axis, and a flow channel is defined by each of the first fan blades and the corresponding second fan blade, each of the flow channels has an inlet and an outlet opposite to each other, wherein at least one of each of the first fan blades and the corresponding second fan blade is provided with a flow guiding hole, wherein the flow guiding hole penetrates through the first blade fan or second blade fan and each of the flow guiding holes is located between the corresponding inlet and the corresponding outlet, each of the flow guiding holes is communicated with the corresponding flow channel.

2. The axial flow fan according to claim 1, wherein at least one of each of the first fan blades and the corresponding second fan blade is provided with a flow guiding portion, which extends into the corresponding flow channel via the corresponding flow guiding hole.

3. The axial flow fan according to claim 2, wherein each of the flow guiding portions extends toward the outlet in the corresponding flow channel.

4. The axial flow fan according to claim 2, wherein each of the flow guiding holes has a first inner edge and a second inner edge opposite to each other and arranged side by side between the inlet and the outlet, each of the first inner edges is located between the corresponding second inner edge and the inlet, and each of the flow guiding portions is connected to the corresponding first inner edge.

5. The axial flow fan according to claim 1, wherein an aperture of each of the flow channels is gradually decreased from the inlet to the outlet.

6. The axial flow fan according to claim 1, wherein each of the flow guiding holes has a first inner edge and a second inner edge opposite to each other and arranged side by side between the inlet and the outlet, each of the first inner edges is located between the corresponding second inner edge and the inlet, and a distance between each of the first inner edges and the corresponding inlet is less than a distance between the corresponding second inner edge and the outlet.

7. The axial flow fan according to claim 1, wherein each of the fan blade sets further comprises a side wall configured to connect the corresponding first fan blade and the corresponding second fan blade, and each of the flow guiding holes is located between the hub and the corresponding side wall.

* * * * *